US005294965A

United States Patent [19]

May

[11] Patent Number: 5,294,965

[45] Date of Patent: Mar. 15, 1994

[54] OSCILLATING PREFUSER TRANSPORT

[75] Inventor: Joseph N. May, Fairport, N.Y.

[73] Assignee: Xerox Corporation, Stamford, Conn.

[21] Appl. No.: 990,383

[22] Filed: Dec. 14, 1992

[51] Int. Cl.[5] ..... G03G 15/00; G03G 21/00

[52] U.S. Cl. ..... 355/312; 355/282; 355/309; 355/321

[58] Field of Search ..... 355/282, 285, 289, 290, 355/295, 309, 312, 316, 208, 321, 308

[56] References Cited

U.S. PATENT DOCUMENTS

| | | | |
|---|---|---|---|
| 3,902,645 | 9/1975 | Keck | 226/44 |
| 4,017,065 | 4/1977 | Poehlein | 271/80 |
| 4,017,067 | 4/1977 | Soures et al. | 355/312 X |
| 4,110,027 | 8/1978 | Sato et al. | 355/309 X |
| 4,348,102 | 9/1982 | Sessink | 355/285 |
| 4,375,326 | 3/1983 | Lang | 355/312 X |
| 4,561,581 | 10/1985 | Kelly | 226/113 |
| 4,745,435 | 5/1988 | Sakata et al. | 355/316 |
| 4,903,047 | 2/1990 | Hatanaka | 355/312 X |
| 4,905,052 | 2/1990 | Cassano et al. | 355/312 |
| 5,063,415 | 11/1991 | Ariyama | 355/312 |
| 5,166,735 | 11/1992 | Malachowski | 355/282 |
| 5,166,736 | 11/1992 | Ogawa et al. | 355/308 |
| 5,170,215 | 12/1992 | Pfeuffer | 355/285 |

OTHER PUBLICATIONS

Xerox Disclosure Journal vol. 4, No. 2, published Mar.-/Apr. 1979.

*Primary Examiner*—Matthew S. Smith

[57] ABSTRACT

An apparatus which compensates for the velocity mismatch between a roll fuser and an image receiver. A vacuum belt transport disposed intermediate the fuser and the image receiver is adapted to have its downstream end pivoted for forming a controlled buckle in an image substrate such as plain paper.

11 Claims, 1 Drawing Sheet

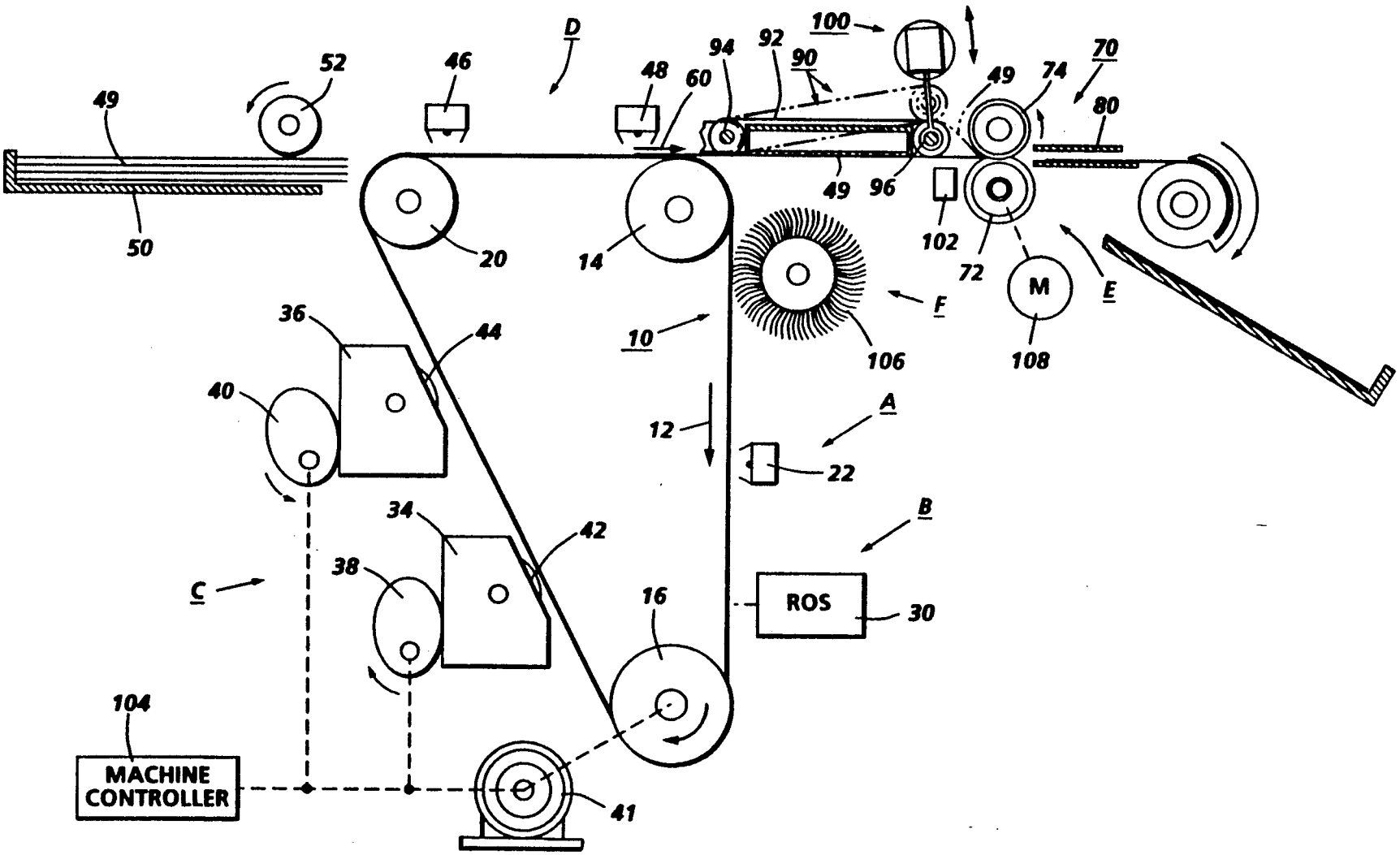
ROS
MACHINE CONTROLLER
M
A
B
C
D
E
F
10
12
14
16
20
22
30
34
36
38
40
41
42
44
46
48
49
50
52
60
70
72
74
80
90
92
94
96
100
102
104
106
108

OSCILLATING PREFUSER TRANSPORT

BACKGROUND OF THE INVENTION

This invention relates generally to electrophotographic printing and more particularly relates to fuser velocity variations which affect the movement of an image bearing substrate between an image receiver and a image fuser.

In imaging systems commonly used today, a charge retentive surface is typically charged to a uniform potential and thereafter exposed to a light source to thereby selectively discharge the charge retentive surface to form a latent electrostatic image thereon. The image may comprise either the discharged portions or the charged portions of the charge retentive surface. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an abhesive material, such as a silicone rubber or other low surface energy elastomer, for example, tetrafluoroethylene resin sold by E. I. DuPont De Nemours under the trademark Teflon. To further enhance release, a release agent material such as silicone oil is applied to elastomer coating.

The velocity of such roll fusers varies in the order of 2-3% of the nominal speed. Thus, in a printing apparatus where the image receiver and roll fuser are positioned close enough so that image transfer and fusing occur simultaneously, image smear prevention must be addressed. The problem is caused by relative movement between the the image receiver and the image substrate to which powder images are transferred from the image receiver. The image receiver may comprise a photoreceptor belt while the image substrate may comprise plain paper.

Smear prevention due to speed mismatch of machine components has been the subject of various publications as will be discussed hereinafter.

U.S. Pat. No. 3,902,645 granted to Keck on Sep. 2, 1975 describes a machine which includes rolls between which a flexible sheet is passed. After passing from one section, the flexible sheet falls downwardly to form a loop, the other side of which passes upwardly into another section of the machine. A motor drives a roll which advances the sheet from one section [one] to the other section. A pivotable plate contacts the lowermost region of the loop. The direction that the plate pivots depends upon the whether the loop is increasing or decreasing. The direction that the plate pivots controls the speed of the motor advancing the sheet.

U.S. Pat. Nos. 4,017,065 granted to Poehlein on Apr. 12, 1977 and 4,058,306 granted to Fletcher on Nov. 15, 1977 disclose a vacuum support interposed between the fuser and the photoreceptor. When the lead edge of the copy sheet enters the fuser roll nip, the vacuum is turned off and a buckle forms in the sheet due to the speed mismatch between the fuser and the photoreceptor.

U.S. Pat. No. 4,561,581 describes a web accumulator positioned between a variable speed drive and an intermittent drive. A portion of a web in the accumulator is curved into a downward extending loop by a curved support and the force of gravity acting on the web.

U.S. Pat. No. 4,905,052 granted to Cassano et al on Feb. 7, 1990 discloses an apparatus which compensates for the velocity mismatch between adjacent sheet transports. A plate, interposed between the sheet transports, supports the sheet until the leading edge thereof advances from the first sheet transport to the second sheet transport. When the leading edge of the sheet is received by the second sheet transport, the plate pivots away from the sheet to a location remote therefrom. Since the first sheet transport advances the sheet at a greater velocity than the second sheet transport, the sheet forms a buckle to compensate for the velocity mismatch between sheet transports.

Xerox Disclosure Journal Volume 4, No. 2 published March/April 1979 discloses a sheet transport between a photoreceptor stripping point and a roll fuser adapted for speed mismatch compensation. A slack, curved belt is used as the transport to provide an initial sheet buckle, which buckle can be pulled out by the fuser over-speed without pulling (sliding) the sheet trail edge on the photoreceptor. A sprocket-driven belt transport is maintained slack in its copy sheet transport side or flight, while its opposite flight is the tension side. A vacuum is applied through the slack side to conform the copy sheet to the belt's concave configuration until the lead edge of the copy sheet reaches the fuser roll nip. The slack can be maintained by a separate drive belt connection the shafts of the two large diameter sprocket wheels supporting the transport belt or belts. Alternatively, the slack can be maintained by driving the upstream wheel while applying drag to the downstream wheel.

BRIEF SUMMARY OF THE INVENTION

Briefly, the problem caused by roll fuser speed variations when an image substrate is transported between an image receiver such as a photoreceptor and a roll fuser is obviated by operating the fuser at 2-3% slower than the speed of the image processor. After the image receiver has entered the roll fuser and the image receiver has just begun to buckle between the fuser and the downstream end of the prefuser transport, the downstream end of the prefuser transport is moved in the direction of the normal buckle for providing positive buckle formation in the image receiver. Once the trail end of the image receiver separates from the photoreceptor, the the prefuser transport is moved back to its non-buckle forming position.

DESCRIPTION OF THE DRAWING

The FIGURE is a schematic illustration of a positive control for buckling an image receiver to compensate for a speed mismatch between a roll fuser and an image receiver.

DETAILED DESCRIPTION OF THE PREFERRED EMBODIMENT(S) OF THE INVENTION

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numeral have been used throughout to designate identical elements. The FIGURE schematically depicts the various components of an illustrative electrophotographic printing machine incorporating the sheet transport velocity mismatch compensation apparatus of the present invention therein. It will become evident from the following discussion that the apparatus of the present invention is equally well suited for use in a wide variety of printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a photoconductive belt 10. Preferably, the photoconductive belt 10 is fabricated from a photoconductive material coated on a grounding layer, which, in turn, is coated on an anti-curl backing layer. The photoconductive material is made from a transport layer coated on a generator layer. The transport layer transports positive charges from the generator layer. The interface layer is coated on the grounding layer. The transport layer contains small molecules of di-m-tolydiphenylbiphenyldiamine dispersed in a polycarbonate. The generation layer is made from trigonal selenium. The grounding layer is made from a titanium coated Mylar. The grounding layer is very thin and allows light to pass therethrough. Other suitable photoconductive materials, grounding layers, and anti-curl backing layers may also be employed.

The photoreceptor belt 10 moves in the direction of arrow 12 to advance successive portions of the belt 10 sequentially through the various processing stations disposed about the path of movement thereof. The belt 10 is entrained about a stripping roller 14, a tension roller 20, and a drive roller 20. Drive roller 16 is coupled to a motor 41 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 1, initially a portion of the belt 10 passes through charging station A. At charging station A, a corona device 22 charges a portion of the photoreceptor belt 10 to a relatively high, substantially uniform potential, either positive or negative.

At exposure station B, a raster output scanner (ROS) 30 is provided to imagewise discharge the photoreceptor in accordance with stored electronic information. The ROS is preferably a three level device capable of forming a tri-level image comprising two image levels and a background level intermediate the two image levels.

Thereafter, the belt 10 advances the electrostatic latent image to development station C. At development station C, either developer housing 34 or 36 is brought into contact with the belt 10 for the purpose of developing the electrostatic latent image. Housings 34 and 36 may be moved into and out of developing position with corresponding cams 38 and 40, which are selectively driven by motor 41. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, either one of the two developer housings may be inactivated by caming it away from the belt 10.

The photoreceptor belt 10 then advances the developed latent image to transfer station D. At transfer station D, a sheet of support material such as paper copy sheets is advanced into contact with the developed latent images on the belt 10. A corona generating device 46 deposits electrostatic charges of a suitable polarity onto the backside of a copy sheet so that the toner powder images are attracted from the photoreceptor belt 10 to the sheet. After transfer, a corona generator 48 sprays electrostatic charges of a suitable polarity on the copy for assisting stripping of the copy sheet from the belt adjacent stripping roller 14.

Sheets of support material 49 are advanced to transfer station D from a supply tray 50. Sheets are fed from tray 50 with sheet feeder 52, and advanced into contact with the photoreceptor belt 10 in the transfer station D.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup or pressure roller 74 with the toner powder images contacting the fuser roller 72. In this manner, the toner powder image is permanently affixed to the sheet, and such sheets are directed via a chute 80 to an output tray or the like, not shown.

Copy substrates 49 are transported from the photoreceptor belt 10 to the fuser assembly 70 via a pivotally mounted belt transport 90 illustrated in its home position by a solid line representation. The transport comprises a belt 92 entrained about a pair of rollers 94 and 96. A vacuum chamber structure 98 supported within the run of the belt 92 serves to hold the copy substrates to the bottom of the belt 92 during transport. A stepper motor 100 operatively connected to the roller 96 serves to pivot the transport 90 about the axis of the roller 94. The transport is pivoted from its solid line position to its dotted line position in response to signals generated by a sensor 102. The senor senses the arrival of the lead edge of a copy substrate and generates signals utilized by machine controller 104 to actuate the stepper motor for pivoting of the transport according to a predetermined algorithm. Pivoting of the transport provides positive control for substrate buckle formation. After the substrate carrying the toner images is out of the transfer station, the transport is returned to its non-buckle forming position shown in solid lines.

Residual particles, remaining on the photoreceptor belt 10 after each copy is made, may be removed at cleaning station F. The cleaning apparatus comprises a brush 106. Removed residual particles may be stored for disposal.

The machine controller 104 is preferably a known programmable controller or combination of controllers, which conventionally control all the machine steps and functions described above. The controller 104 is responsive to a variety of sensing devices including the lead edge sensor 102 to enhance control of the machine, and also provides connection of diagnostic operations to a user interface (not shown) where required. A motor 108 for driving the fuser roll 72 is also controlled by the controller 104.

As thus described, a reproduction machine in accordance with the present invention may be any of several well known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein.

What is claimed is:

1. An apparatus that compensates for velocity mismatches in transporting image substrates along a predetermined path, including:

an image receiver;

a fuser for fixing powder images to said image substrates;

a transport disposed intermediate said image receiver and said fuser for positively conveying image substrates from said image receiver to said fuser;

means for operating said fuser at a slower speed than said image receiver whereby said image substrates tend to form a buckle adjacent said fuser;

means for adjusting the operating position of one end of said substrate transport for effecting formation of a buckle in said image substrate until said image substrates separate from said image receiver.

2. An apparatus according to claim 1 wherein said image substrates contact a top portion of said image receiver for transfer of toner images thereto.

3. An apparatus according to claim 2 wherein said transport comprises belt and means for attracting said substrates to the bottom of said belt.

4. An apparatus according to claim 3 wherein said adjusting means comprises means for pivoting the downstream end of transport.

5. An apparatus according to claim 4 wherein said means for operating said fuser at a slower speed than said image receiver comprises a motor for operating said fuser at a speed in the order of 2–3% slower than its nominal speed.

6. An apparatus according to claim 5 wherein said sheet transport includes vacuum means in communication with said belt to releasably secure a substrate thereto.

7. An apparatus that compensates for velocity mismatches in transporting an image substrates or sheets along a predetermined path, including:

a sheet transport adapted to advance the sheets along a first portion of a path of travel at a first velocity;

a second sheet transport adapted to advance the sheets along a second portion of the path at a second velocity with the first velocity of said first sheet transport being greater than the second velocity of said second sheet transport; and means interposed between said first sheet transport and said second sheet transport, for positively moving said sheets from said first sheet transport to said second sheet transport; and means moving the end of said interposed means adjacent said second sheet transport for forming a buckle in said sheet thereby compensating for the difference in velocity between said transports.

8. An apparatus according to claim 7 wherein said first transport comprises an image receiver and said sheets contact a top portion of said image receiver for transfer of toner images thereto.

9. An apparatus according to claim 8 wherein said interposed means comprises a belt means for attracting said sheets to the bottom of said belt.

10. An apparatus according to claim 9 wherein said means for operating said second transport at a slower speed than said first transport comprises a motor for operating said second transport at a speed in the order of 2–3% slower than its nominal speed.

11. An apparatus according to clam 10 wherein said interposed means includes vacuum means in communication with said belt to reliably secure a substrate thereto.

* * * * *